US008701580B2

(12) United States Patent
Feteih

(10) Patent No.: US 8,701,580 B2
(45) Date of Patent: Apr. 22, 2014

(54) BOAT AND METHOD OF DESIGNING SAME

(76) Inventor: Mohamed Zaher M. Feteih, Jeddah (SA)

( * ) Notice: Subject to any disclaimer, the term of this patent is extended or adjusted under 35 U.S.C. 154(b) by 174 days.

(21) Appl. No.: 13/411,504

(22) Filed: Mar. 2, 2012

(65) Prior Publication Data

US 2013/0228118 A1 Sep. 5, 2013

(51) Int. Cl.
*B63B 43/10* (2006.01)

(52) U.S. Cl.
USPC ..... 114/69; 114/357; 114/182

(58) Field of Classification Search
USPC ..... 114/182, 68, 69, 357
See application file for complete search history.

(56) References Cited

U.S. PATENT DOCUMENTS 3,734,047 A * 5/1973 Burton ..... 114/39.21
3,747,550 A * 7/1973 Stoeberl ..... 114/39.21
5,662,063 A * 9/1997 Seijas ..... 114/361

* cited by examiner

*Primary Examiner* — Stephen Avila
(74) *Attorney, Agent, or Firm* — Richards Patent Law P.C.

(57) ABSTRACT

With the objective of providing a small fiberglass boat that fulfills the criteria of being self-bailing, self-righting and being unsinkable, the boat may include: a hull including a deck at the waterline dividing the boat into a lower portion below the waterline and an upper portion above the waterline and a centerline defining the separation between the starboard side and port side; an additional weight equivalent to approximately forty percent of the weight of the hull located within the lower portion of the hull approximately along the centerline of the hull; a series of scuppers located in the upper portion of the hull; a buoyant element located above the upper portion of the hull; and buoyant material placed within the lower portion of the hull. The deck may further include a partition dividing the deck into two channels.

19 Claims, 4 Drawing Sheets

BOAT AND METHOD OF DESIGNING SAME

BACKGROUND OF THE INVENTION

The present subject matter relates generally to motorboats. More specifically, the present invention relates to a design for a small (approximately 20-36 foot), fiberglass, recreational, fishing, or sport-type motorboat that satisfies three important safety criteria simultaneously: selfrighting, self-bailing, and being unsinkable. The present subject matter further discloses a method for retrofitting motorboats to achieve the same safety criteria.

The majority of boating fatalities have little to do with bad weather or hazardous sea conditions. They typically occur in smaller, open boats on inland waters during daylight hours when weather and visibility are good, winds are light, and the water is calm. Despite these ideal circumstances, passengers fall overboard and many boats capsize, flood, or sink, resulting in over half of all boating fatalities.

Capsizing is when a boat turns on its side or turns completely over becoming disabled. The act of reversing a capsized vessel is known as righting. Accordingly, a vessel may be designated as self-righting if it is specifically designed to be able to selfright when capsized, i.e., return to upright position without intervention. Some boats are designed to be self-righting with minimal assistance.

Flooding (or swamping) occurs when a boat stays upright and fills with water. To prevent this from happening, safety features may be incorporated in the boat design allowing it to be described as self-bailing. Typically, these systems consist of drains that automatically empty water from the deck or cockpit, either by gravity, through scuppers, or by Bernoulli Effect. Other boats have openings that drain water into the bilge or a sump, both of which require an electric pump to evacuate the water.

Sinking is the catastrophic result that occurs when bailing is impossible and the boat becomes fully submerged and eventually totally sinking to the bottom of the sea. A variety of hull designs may be filled with a variety of different lightweight materials to prevent sinking and ensure the boat maintains level flotation and stability above the waterline in the event of an accident.

Safety features to avoid the dangers of boats capsizing, flooding, and sinking, and ultimately save lives, are typically integral to the designs of larger vessels (greater than 36 foot) as well as those of some smaller watercraft primarily intended as rescue or lifeboats, including rigid inflatable boats (RIBS). Ideally, motorboats in the recreational, fishing, and sport classes, which are more prone to such calamities due the increased likelihood of being piloted by less experienced sailors and their intrinsic instability resulting from smaller size, would also include features to address all of these concerns.

However, until now there have been no small fiberglass recreational/fishing motorboats in these categories that successfully fulfill all three safety criteria simultaneously; of being self-righting, self-bailing, and unsinkable, and are able to achieve these characteristics in an efficient, simple and cost effective manner based on a design concept. Accordingly, a need exists for a motorboat design as described and claimed herein.

SUMMARY OF THE INVENTION

The small motorboat design disclosed herein provides means for achieving the three important safety criteria of being self-righting, self-bailing, and unsinkable. All of these characteristics are addressed through an integrated simplified method, and without complicated or expensive equipment, thereby reducing the cost of manufacturing the boat. The present subject matter further discloses a method for retrofitting motorboats with the tools necessary to achieve being self-righting, self-bailing, and unsinkable. It is important to note that while the primary embodiment is described with reference to a small recreational motorboat, the concepts taught herein may be applied to boats of nearly all sizes and categories.

Various embodiments of motorboats may achieve the advantages of the innovative methods provided herein. In one example, a 23-foot, fiberglass motorboat, intended for recreation, fishing, or sport activities, simultaneously fulfills the three safety criteria of being self-righting, self-bailing, and unsinkable. An innovative design is provided in which the volume and placement of buoyant material is calculated and integrated into the hull bottom and sides, making the boat unsinkable and self-bailing. The hull design, unique weight distribution strategies, and a buoyant roof element (e.g., shade canopy, bimini top, targa top, enclosed cabin, etc.) collectively function as a system producing the boat's ability to self-right without external power, equipment, or assistance.

A stability analysis process may be used to design, construct, and/or retrofit boats to improve the boat's ability to be self-righting, self-bailing, and unsinkable. In one example, the stability analysis method includes calculations and testing as provided in the following steps:

(1) The center of gravity, the point in the boat where all the forces of gravity are equal, is determined and recorded both in and out of the water.

(2) The weight of the boat's hull loaded (with motor, tanks, equipment, etc.) and unloaded is confirmed.

(3) The water line, the line to which the hull is immersed when loaded, is measured and marked.

(4) The boat is submerged, the total volume of water that completely fills the hull is quantified, and its equivalent weight is calculated. The waterline is determined again. The freeboard, the height of the boat's side between the water line and the deck surface, will vary at this stage based on the design and in some instances the boat may become submerged.

(5) A weight equal to approximately forty percent of the unloaded hull is placed as low as possible mostlyin the middle third of the boat along its length and close to the centerline.

(6) The total weight is calculated by adding the values of the loaded hull, the weight of water calculated in step (4), and the value of the added weight calculated in step (5).

(7) The calculated total weight is divided by the buoyant force of the specific buoyant material to be used, which is typically a foam material. For example, one cubic foot of a typical foam provides a buoyant force of approximately 62 lbs. Accordingly, the total weight is divided by this value. The resultant is the volume of the buoyant material required to keep the boat afloat in the event it becomes completely flooded, and to ensure that the scuppers will be above the waterline.

(8) The calculated volume of buoyant material is then distributed throughout the bottom and sides of the hull. The distribution is based on the individual hull shape and weight distribution design.

(9) Optimum locations for the buoyant material may be revealed through iterative calculations and testing.

In addition to the weight incorporated into the low middle portion of the boat, and the buoyant material incorporated into the bottom and sides of the hull, the self-righting characteristics of the boat may be improved by providing a buoyant roof element or similar elevated buoyant structure designed to increase the height of the righting arm (a notional lever through which the force of buoyancy acts expressed as the horizontal distance between the center of buoyancy and the center of gravity).

Unlike other small motorboats in the recreational, fishing, and sport categories that may be self-bailing, unsinkable, or in some cases both, the motorboat disclosed herein is designed to be not only self-bailing and unsinkable, but also self-righting.

An object of the present invention is to provide a small motorboat that is not dependent on any complex external equipment or systems for its self-righting ability. Providing a weight equal to forty percent of the unloaded hull situated as low as possible in the middle third of the boat along its length contributes to, but is not solely responsible for, this function.

For small, open, and outboard powered boats (typical of the boats intended to benefit from the subject matter disclosed herein), additional force is necessary to increase the height of the righting arm and reestablish the static and stable condition where the center of gravity and the center of buoyancy are aligned vertically. To that end, a buoyant roof element (e.g., a shade canopy, bimini top, targa top, enclosed cabin, etc.) is a design feature (whether original or retrofit) that helps to provide the force needed to initiate the self-righting act.

It is another object of the invention to provide a small motorboat with a deck or cockpit that is self-bailing, without the use of electrical or manual sump/bilge pumps, based on its novel hull concept. At this point it is vitally important to clarify and document an issue related to the definition and application of the "self-bailing" characteristic.

In most of existing motorboats, self-bailing means the ability of the boat to clear its deck from limited amounts of water. The word "limited" here is key. If the amount of water happens to be more than a certain volume, and its weight happens to drop the hulls scuppers (the openings on the deck, usually on the sides, that drain the water back to the sea) below the waterline, then the scuppers will cease to drain water, and may become a source of incoming water, thus making a hazardous situation even worse. This usually happens in the uncommon, yet catastrophic, event of the boat being "swamped," i.e., when a huge amount of water fills/floods the entire deck within a very short duration, typically caused by a single large wave. The sudden overwhelming weight of the water causes the hull to sink (inches or feet), thus leading to the situation described above. Even boats with the most powerful bilge pumps will not be able to cope with this situation. The totally flooded boat then becomes very unstable and liable to capsize. At best, even if the flooded boat remains upright, and now the self-bailing ability lost, the deck will remain full of water, thus exposing the passengers to the "elements," i.e., the water, wind and other materials slushing inside the boat, which contributes to morbidity/mortality due to falling overboard and hypothermia. In addition, when flooded some of the areas of the boat are typically inaccessible and thus functionality becomes limited, making passengers unable to cope with the disaster.

By contrast, the boat design provided herein ensures all water from the deck will be bailed out, even if the boat is swamped, thus leaving the boat floating, stable, and functional and the passengers protected from the elements. The design also enables the boat to remain stable in the case in which there is a major hole at the bottom or sides of the hull due to an accident such as striking a reef or other object.

In one example, the boat includes: a hull including a deck at the waterline dividing the boat into a lower portion below a waterline and an upper portion above the waterline and a centerline defining the separation between the starboard side and port side; an additional weight equivalent to approximately forty percent of the weight of the hull located within the lower portion of the hull approximately along the centerline of the hull; a series of scuppers located in the upper portion of the hull; a buoyant element located above the upper portion of the hull; and buoyant material placed within the lower portion of the hull, the amount of buoyant material having a buoyant force approximately equal to the weight of the boat, including the hull and additional weight, plus the weight of a volume of water required to completely fill the hull. The boat may be a fiberglass recreational motorboat that is approximately twenty-three in length. Of course, the principles taught herein may be applied to a wide variety of boats.

The additional weight may be located along the lowest internal section of the hull along a central third of the centerline. The scuppers may be located approximately adjacent to the waterline on the upper portion of the hull. The buoyant element may be attached to and extend above from the hull and may be a buoyant shade canopy, a buoyant bimini top, a buoyant targa top, a buoyant cabin, or another buoyant element. The deck may further include a partition located along the centerline of the hull separating the deck into two channels.

The buoyant material may be located along the bottom and sides of the lower portion of the hull and may be a closed-cell foam, air sealed within one or more air-tight compartments, or another buoyant material.

The method of designing a self-righting, self-bailing, and unsinkable boat may include the steps of: (a) determining the center of gravity of a boat including a hull; (b) measuring the weight of the loaded boat; (c) identifying the preliminary waterline; (d) calculating the equivalent weight of the total volume of water required to completely fill the hull; (e) determining the waterline when the hull is filled with water; (f) incorporating an additional weight of approximately forty percent of the weight of the unloaded hull along the middle third of the boat along its length; (g) calculating the total weight of the boat including the weight of the loaded hull, the weight of the water calculated in step (d), and the additional weight added in step (f), and dividing the total weight by the buoyant force of the buoyant material to be used to determine the volume of buoyant material required to keep the boat afloat in the event it becomes completely flooded; (h) distributing the calculated volume buoyant material throughout the bottom and sides of the hull; (i) determining the optimum location of the buoyant material; (j) providing a plurality of scuppers above the waterline of the hull; and (k) providing an elevated buoyant element above the hull.

The step of determining the center of gravity of a boat may include determining the center of gravity of the boat both in and out of water. The step of determining the optimum location of the buoyant material may include iterating the design process by repeating the method varying the location of the buoyant material and comparing the results to identify the optimum location of the buoyant material. The method may further include the step of providing a deck located at the waterline of the hull including a partition located along the centerline of the hull separating the deck into two channels.

The partition along the deck (at the centerline of the hull) separates the deck into two channels. While the partition may act as a seat and/or a compartment for storage, it is primarily beneficial in that it serves to counteract the free surface effects by minimizing changes in the center of mass of the boat when free water sloshes towards the port or starboard sides, ultimately making the boat more stable, minimizing its resistance to being self-righting, and minimizing the risk of capsizing.

The method may applied to the initial design process of the boat or may be applied to retrofitting an existing boat.

It is another object of the invention to provide a small motorboat that is unsinkable due to its hull design, the application of calculated weight distribution strategies, and optimally located buoyant material.

Many existing boats claim to be unsinkable because the "nose" or some other small percentage of the boat may remain above water in catastrophic events, leaving the passengers to hold on to the floating portion of the boat, while floating in the water themselves. It is another object of the invention, to provide a boat design that maintains a fully floating stable hull, clear of water under otherwise catastrophic conditions.

It is another object of the invention to provide a motorboat that incorporates the safety criteria of being self-righting, self-bailing, and unsinkable and can also be simply and efficiently manufactured with reduced cost.

It is a further object of the invention to provide a methodology for applying the safety criteria of being self-righting, self-bailing, and unsinkable to both new and existing small motorboats.

Additional objects, advantages, and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities, and combinations particularly pointed out in the appended claims.

BRIEF DESCRIPTION OF THE DRAWINGS

The drawings depict one or more implementations of the present subject matter by way of example, not by way of limitation. In the figures, the reference numbers refer to the same or similar elements across the various drawings.

DETAILED DESCRIPTION OF THE INVENTION

Figure 1:
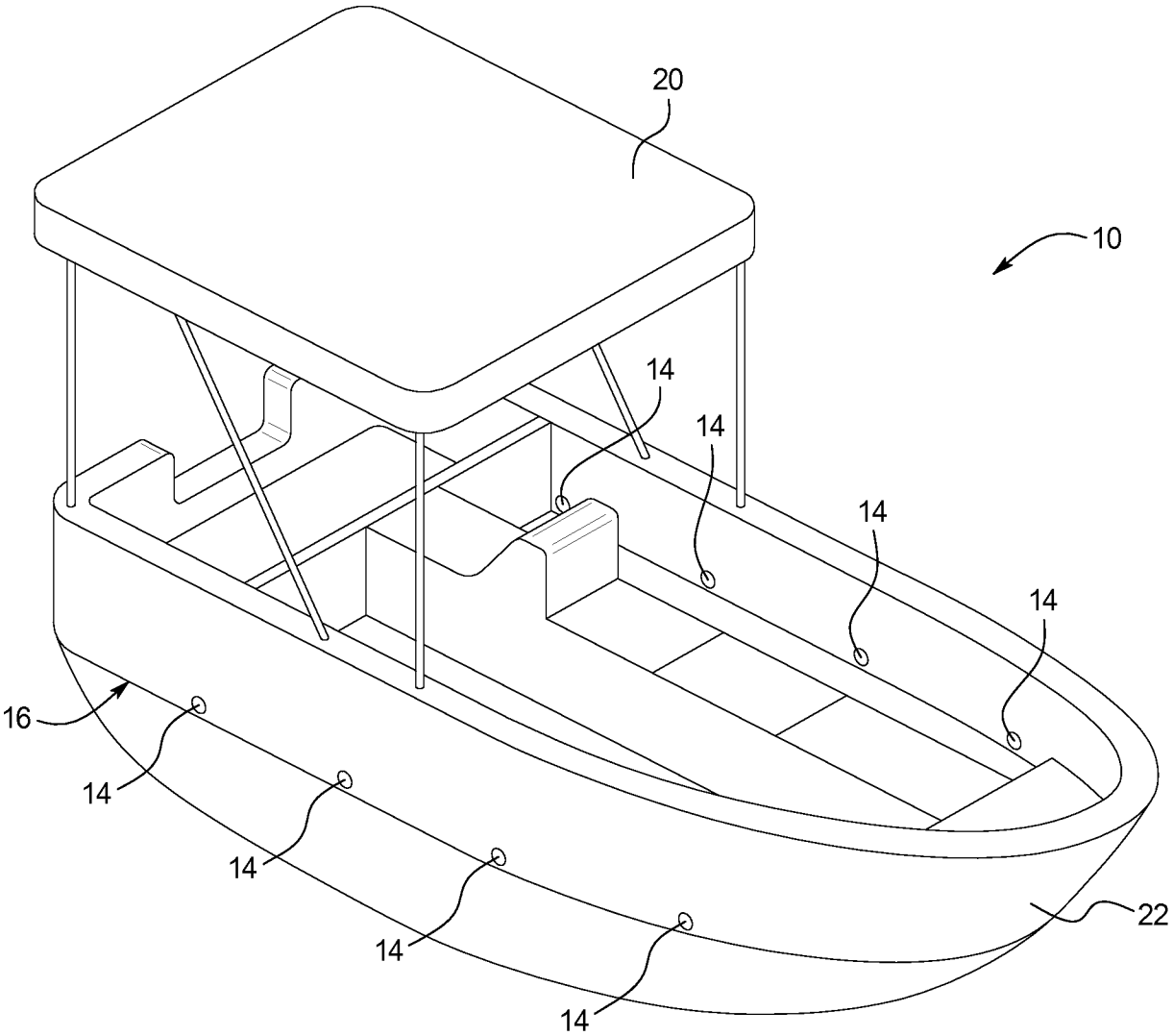
FIG. 1 is a perspective view of a boat embodying the concepts disclosed herein.

FIG. 1 illustrates a preferred embodiment of a boat 10 according to the present invention. As shown in FIG. 1, the boat 10 includes a calculated amount of buoyant material 12 (shown in FIG. 3) placed appropriately within the boat 10 to improve the ability of the boat 10 to be unsinkable. In addition, the boat 10 includes a series of scuppers 14 located above the waterline 16 to improve the ability of the boat 10 to be self-bailing. Further, the boat 10 includes an additional weight 18 (shown in FIG. 4) in the lower middle third of the boat 10 and an elevated buoyant element 20 to improve the ability of the boat 10 to be self-righting. These elements and features will be described in further detail herein.

Figure 2:
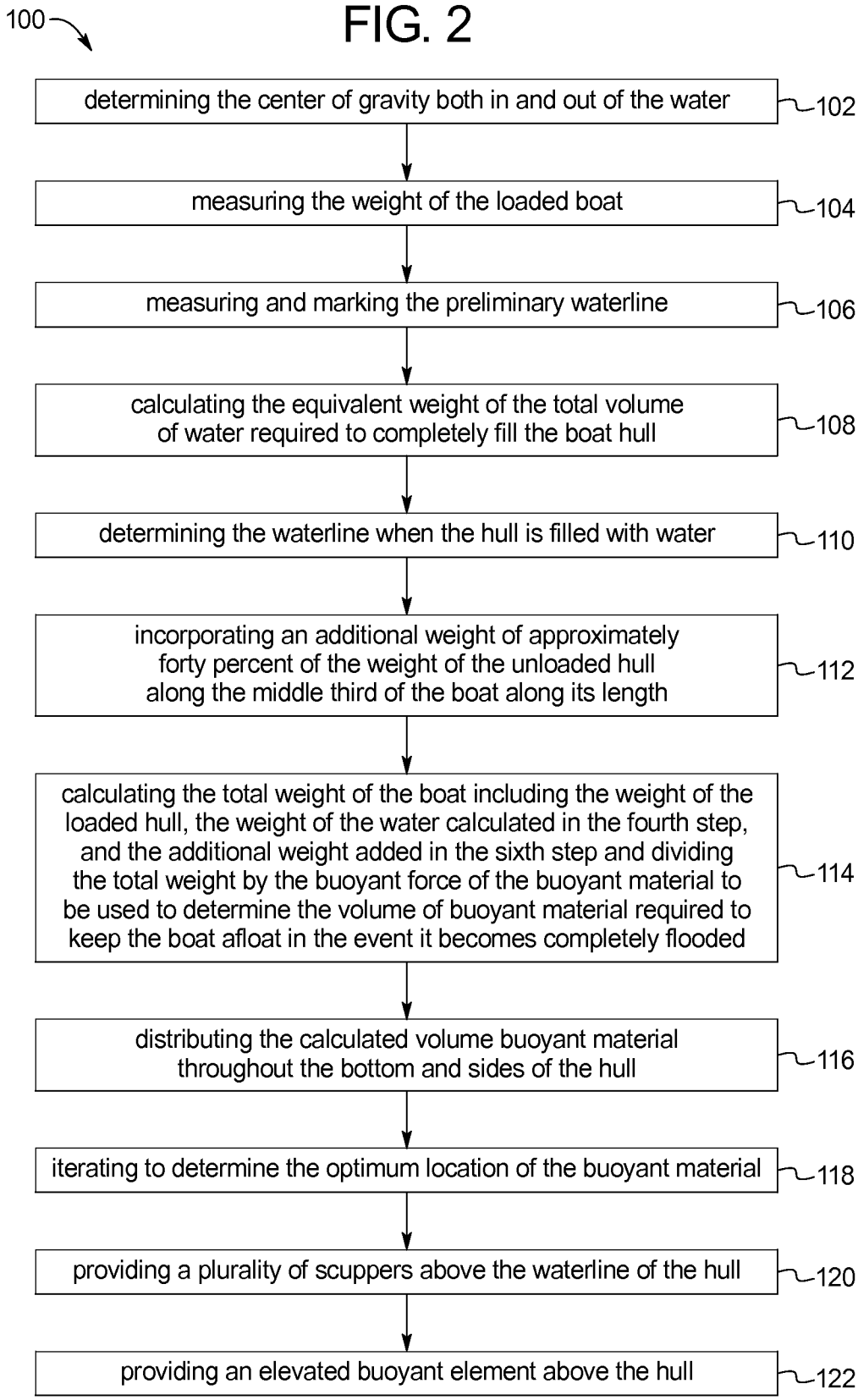
FIG. 2 is a flow chart illustrating a method of designing and/or retrofitting a boat design to make it self-righting, self-bailing, and unsinkable.

FIG. 2 illustrates a method 100 of designing a self-righting, self-bailing, and unsinkable boat 10. As shown in FIG. 2, the method 100 provides a stability analysis process that may be used to design, construct, and/or retrofit boats 10 to improve the boat's ability to be self-righting, self-bailing, and unsinkable. In the example shown, the method 100 includes the following steps: a first step 102 of determining the center of gravity both in and out of the water; a second step 104 of measuring the weight of the loaded boat 10; a third step 106 of identifying (i.e., measuring and marking) the preliminary waterline 24; a fourth step 108 of calculating the equivalent weight of the total volume of water required to completely fill the boat hull 22; a fifth step 110 of determining the waterline 16 when the hull 22 is filled with water; a sixth step 112 of incorporating an additional weight 18 of approximately forty percent of the weight of the unloaded hull 22 along the middle third 24 of the boat 10 along its length; a seventh step 114 of calculating the total weight of the boat 10 including the weight of the loaded hull 22, the weight of the water calculated in the fourth step 108, and the additional weight 18 added in the sixth step 112 and dividing the total weight by the buoyant force of the buoyant material 12 to be used to determine the volume of buoyant material 12 required to keep the boat afloat in the event it becomes completely flooded; an eighth step 116 of distributing the calculated volume buoyant material 12 throughout the bottom and sides of the hull 22; a ninth step 118 of iterating to determine the optimum location of the buoyant material 12; tenth step 120 of providing a plurality of scuppers 14 above the waterline 16 of the hull 22; and an eleventh step 122 of providing an elevated buoyant element 20 above the hull 22.

While the method 100 shown in FIG. 2 is a presently preferred method 100 of designing a self-righting, self-bailing, and unsinkable boat 10, it is understood that the methodology may be varied while accomplishing the advantages of the subject matter disclosed herein. For example, while elements such as the elevated buoyant element 20 may improve the ability of the boat 10 to be self-righting, it may be optional in some embodiments of the boat 10, without limiting the boat's ability to be self-righting. Additionally, while some of the steps provided above are described in the context of adding elements to an existing boat 10, the concepts provided herein may be incorporated into the initial design. For example, the sixth step 112 of incorporating an additional weight 18 of approximately forty percent of the weight of the unloaded hull 22 along the middle third 24 of the boat 10 along its length may be accounted for in the initial design of the hull 22, such that the it may not be considered "additional weight." Variations of the method 100 provided herein and described in a preferred arrangement with respect to FIG. 2 will be apparent to one skilled in the art based on the disclosures and teachings provided herein.

Turning back to FIG. 1, a presently preferred embodiment of a boat 10 designed according to the method 100 described with reference to FIG. 2 is provided. As shown in FIG. 1, some of the elements that distinguish this boat 10 from previous designs are the combination of the volume and location of the buoyant material 12, the location of the series of scuppers 14, the additional weight 18 in the lower middle third of the boat 10, and the elevated buoyant element 20.

As described above with respect to method 100 described in reference to FIG. 2, the volume and location of the buoyant material 12 is carefully calculated and executed. This buoyant material 12 is one of the key elements in creating an unsinkable boat 10.

The volume of buoyant material 12 to be used is calculated by dividing the total of the weight of the loaded hull 20

(including the motor, tanks, equipment, etc.), the weight of the volume of water required to fill the hull 22, and the weight of the additional weight 18 (described further herein) by the buoyant force of the buoyant material 12. In a preferred example, the buoyant material 12 is a closed-cell foam, though it is understood that various buoyant materials 12 may be used, including air sealed within one or more air-tight compartments.

Figure 3:
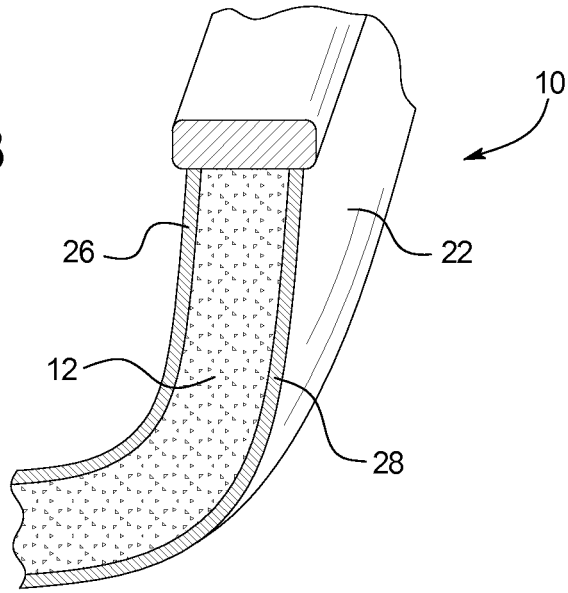
FIG. 3 is a perspective view of the inner shell of the hull of the boat shown in FIG. 1.
Figure 4:
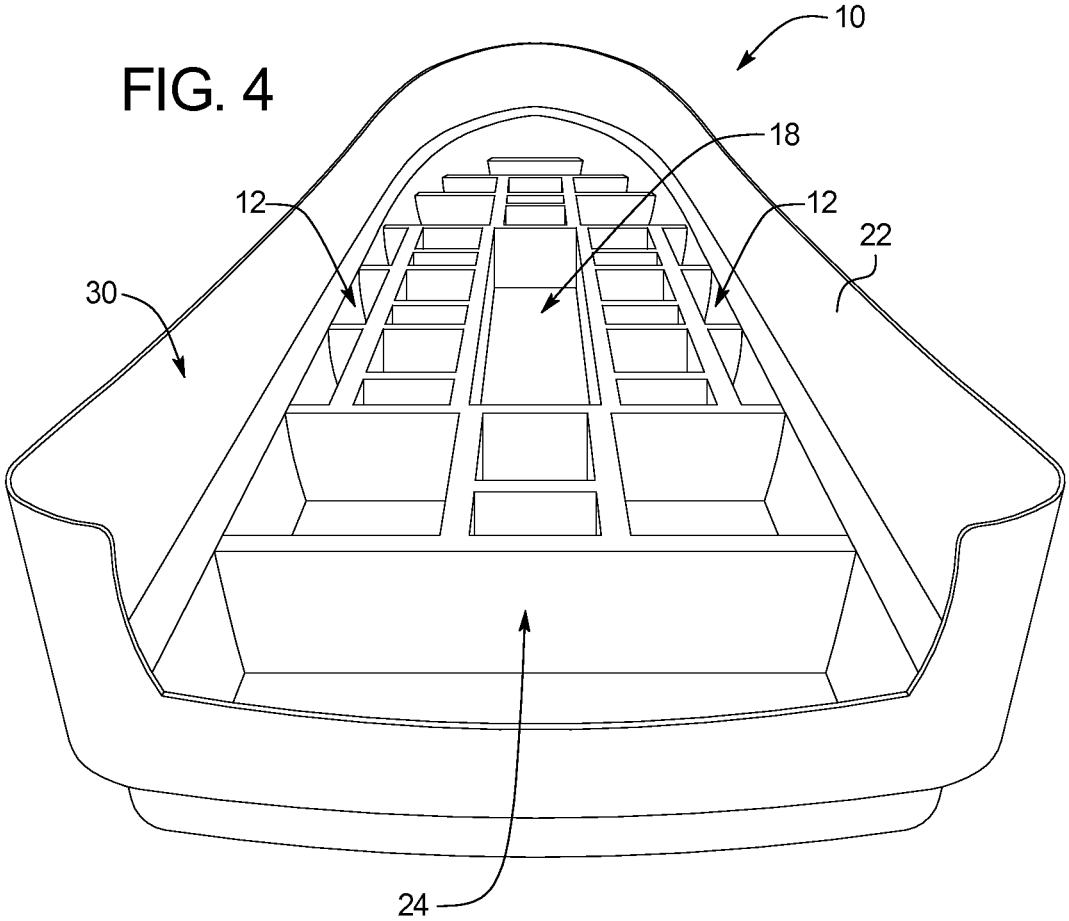
FIG. 4 is perspective view of the lower level of the hull of the boat shown in FIG. 1.

The preferred location for the placement of the buoyant material 12 is generally along the bottom and sides of the hull 22. However, it is understand that the exact details of the placement of the buoyant material 12 may be further improved by an iterative testing and revising process applied to each individual hull 22 and boat 10 design. FIG. 3 illustrates an example of an inner shell 26 of the hull 22 of the boat 10. As shown, a portion of the buoyant material 12 may be distributed between the inner shell 26 and the outer shell 28 of the hull 22. In addition, FIG. 4 illustrates an example of a lower level 30 of the hull 22 of the boat 10. As shown in FIG. 4, the remaining buoyant material 12 may be distributed within the lower level 30 of the hull 22, particularly towards the outer sides of the hull 22. Variations in the placement of the buoyant material 12 will be made to accommodate various hull 22 designs as will be apparent to one skilled in the art based on the disclosure and teachings herein.

Turning back to FIG. 1, the location of the series of scuppers 14 is a critical element in improving the ability of the boat 10 to be self-bailing. As shown in FIG. 1, the scuppers 14 are located above the waterline 16, thereby ensuring the scuppers 14 will be effective, even when the hull 22 is completely filled with water. As described in reference to the method 100 shown in FIG. 2, the waterline 16 may be determined as part of an iterative process. As additional weight 18 is added to the boat 10, the waterline 16 lowers. As the buoyant material 12 is added, the waterline 16 raises. Accordingly, the design and placement of the scuppers 14 may be best reserved for final stages of the design.

The proper location of the scuppers 14 is very important to the self-bailing properties of the boat 10. Using scuppers 14 that remain above the waterline 16, even when the hull 22 is entirely filled with water, ensures that there are no circumstances in which the scuppers will not assist in bailing the boat 10. In addition, using passive scuppers 16, as opposed to active pumps, ensures that the boat 10 will remain self-bailing without concern of electrical or mechanical failure. In addition, it is recognized that by locating the deck 32 approximately at the waterline of the loaded hull 22, and the scuppers 14 directly above the deck 32, the scuppers 14 may perform optimally to enhance the ability of the boat 10 to be self-bailing.

As described above with respect to the method 100 described with reference to FIG. 2, additional weight 18 is provided in the lower middle third of the boat 10 to improve the self-righting ability of the boat 10. As shown in FIG. 4, the additional weight 18 may be provided along the centerline of the hull 22 within the lower level 30 of the boat 10. In the presently preferred embodiment, the additional weight 18 is equal to approximately forty percent of the unloaded weight of the hull 22. However, it is understood that the precise location of the additional weight 18 may increase or decrease the ratio of the additional weight 18 to the weight of the unloaded hull 22. For example, the preferred ratio has been established when placing the additional weight 18 as low in the hull 22 as possible. Raising the location of the additional weight 18 may require a corresponding increase in the weight of the additional weight 18.

As further shown in FIG. 4, the additional weight 18 is provided along the centerline of the boat 10 (from front to back), generally within the middle third of the hull 22. This location has been found to be very effective in improving the self-righting properties of the boat 10. While the preferred embodiment described herein utilizes the middle third of the hull 22 along the boat's centerline as the location of the additional weight, it is understood that variations may be used and that the location of the weight will impact the quantity of the weight needed to provide the desired self-righting characteristics.

In addition to the additional weight 18, the elevated buoyant element 20 assists in improving the self-righting characteristics of the boat 10 by increasing the height of the righting arm. In the example shown in FIG. 1, the elevated buoyant element 20 is a buoyant canopy, though the design of the elevated buoyant element 20 may be quite varied. Examples include a buoyant shade canopy, a buoyant bimini top, a buoyant targa top, a buoyant cabin, etc. Any buoyant element elevated above the hull 22 will help improve the self-righting characteristics of the boat 10. The height of the righting arm (which is increased by the addition of the elevated buoyant element 20) helps to reestablish the static and stable condition where the center of gravity and the center of buoyancy are aligned vertically. Again, the specific embodiment of the elevated buoyant element 20 may be varied to most appropriately match the design of the boat 10 as will be recognized by those skilled in the art based on the disclosure and teachings provided herein.

In addition to the features described above, the boat 10 may be adapted to combat the free surface effects, and related slosh dynamics effects, that occur when water is present on the deck 32 or in other open areas of the boat 10. If not counteracted, the free surface effect can cause the boat 10 to capsize. In brief, the free surface effect is the effect caused by free water moving within the boat 10 in response to changes in attitude of the boat 10. As the boat 10 tips in one direction, the free water flows in that direction, altering the center of mass of the boat 10 and counter-acting any righting effect.

Figure 5:
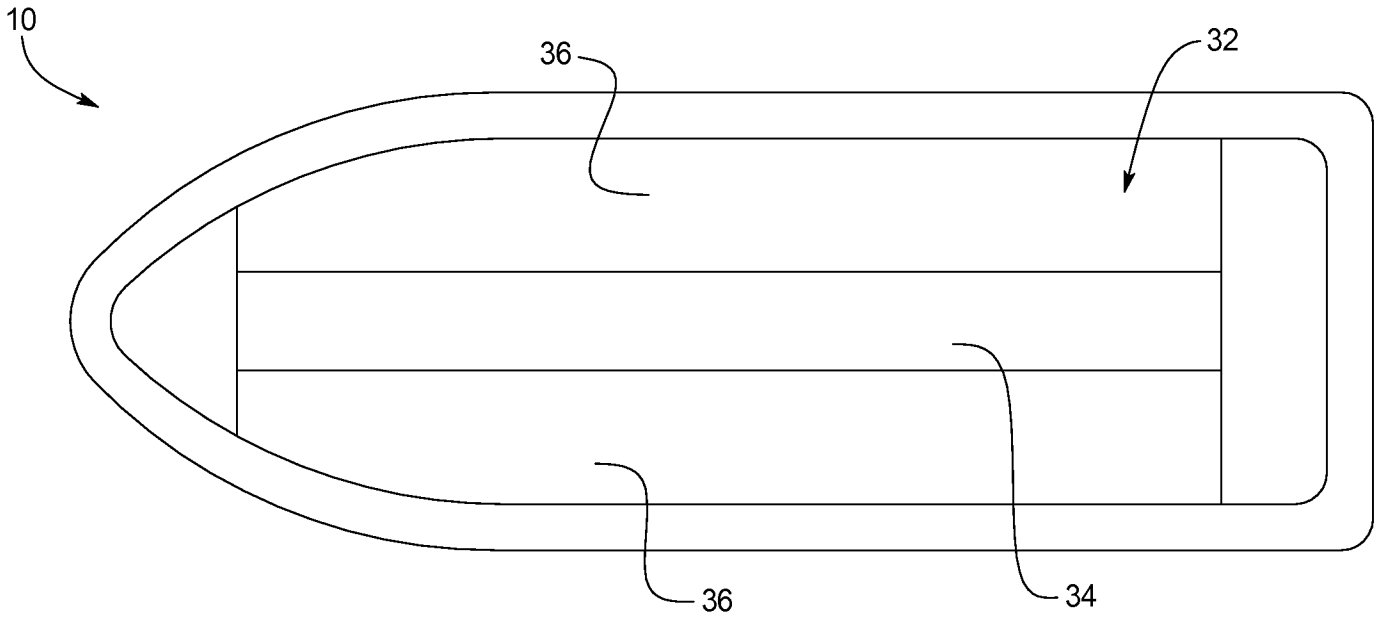
FIG. 5 is a top view of the deck of the boat shown in FIG. 1.

Turning now to FIG. 5, a top view of the boat 10 illustrates a partition 34 located along the midline of the boat 10 (centerline of the hull 22) separating the deck 32 into two channels 36. While the partition 34 may act as a seat and/or a compartment for storage, it is primarily beneficial in that it serves to counteract the free surface effects by minimizing changes in the center of mass of the boat 10 when free water sloshes towards the port or starboard sides, ultimately making the boat 10 more stable, minimizing its resistance to being self-righting, and minimizing the risk of capsizing. It is understood that the separation of the deck 32 into two channels 36, and the corresponding resistance to the slosh dynamics effects, can have a profound effect on the stability of the boat 10.

It should be noted that various changes and modifications to the presently preferred embodiments described herein will be apparent to those skilled in the art. Such changes and modification may be made without departing from the spirit and scope of the present invention and without diminishing its advantages.

I claim:

1. A boat comprising:

a hull including a deck at the waterline dividing the boat into a lower portion below a waterline and an upper portion above the waterline and a centerline defining the separation between the starboard side and port side;

a deck including a partition located along the centerline of the hull separating the deck into two channels;

an additional weight equivalent to approximately forty percent of the weight of the hull located within the lower portion of the hull approximately along the centerline of the hull;

a series of scuppers located in the upper portion of the hull;

a buoyant element located above the upper portion of the hull; and buoyant material placed within the lower portion of the hull, the amount of buoyant material having a buoyant force approximately equal to the weight of the boat, including the hull and additional weight, plus the weight of a volume of water required to completely fill the hull.

2. The boat of claim 1 wherein the hull is that of a fiberglass recreational motorboat.

3. The boat of claim 2 wherein the hull is approximately twenty-three feet in length.

4. The boat of claim 1 wherein the additional weight is located along the lowest internal section of the hull along a central third of the centerline.

5. The boat of claim 1 wherein the scuppers are located approximately adjacent to the deck partition on the upper portion of the hull.

6. The boat of claim 1 wherein the buoyant element is attached to and extends above from the hull.

7. The boat of claim 6 wherein the buoyant element is a buoyant shade canopy.

8. The boat of claim 6 wherein the buoyant element is a buoyant bimini top.

9. The boat of claim 6 wherein the buoyant element is buoyant targa top.

10. The boat of claim 6 wherein the buoyant element is a buoyant cabin.

11. The boat of claim 1 wherein the buoyant material is located along the bottom and sides of the lower portion of the hull.

12. The boat of claim 1 wherein the buoyant material includes a closed-cell foam.

13. The boat of claim 1 wherein the buoyant material includes air sealed within one or more air-tight compartments.

14. A method of designing a self-righting, self-bailing, and unsinkable boat comprising the steps of:

(a) determining the center of gravity of a boat including a hull;

(b) measuring the weight of the loaded boat;

(c) identifying the preliminary waterline;

(d) calculating the equivalent weight of the total volume of water required to completely fill the hull;

(e) determining the waterline when the hull is filled with water;

(f) incorporating an additional weight of approximately forty percent of the weight of the unloaded hull along the middle third of the boat along its length;

(g) calculating the total weight of the boat including the weight of the loaded hull, the weight of the water calculated in step (d), and the additional weight added in step (f), and dividing the total weight by the buoyant force of the buoyant material to be used to determine the volume of buoyant material required to keep the boat afloat in the event it becomes completely flooded;

(h) distributing the calculated volume buoyant material throughout the bottom and sides of the hull;

(i) determining the optimum location of the buoyant material;

(j) providing a plurality of scuppers above the waterline of the hull; and (k) providing an elevated buoyant element above the hull.

15. The method of claim 14 wherein the step of determining the center of gravity of a boat includes determining the center of gravity of the boat both in and out of water.

16. The method of claim 14 wherein the step of determining the optimum location of the buoyant material includes iterating the design process by repeating the method varying the location of the buoyant material and comparing the results to identify the optimum location of the buoyant material.

17. The method of claim 14 wherein the method is applied to the initial design process of the boat.

18. The method of claim 14 wherein the method is applied to retrofitting an existing boat.

19. The method of claim 14 further including the step of providing a deck located at the waterline of the hull including a partition located along the centerline of the hull separating the deck into two channels.

* * * * *